US006748877B2

(12) United States Patent
Kelldorf

(10) Patent No.: US 6,748,877 B2
(45) Date of Patent: Jun. 15, 2004

(54) SECUREMENT ARRANGEMENT

(76) Inventor: Mitchell T. Kelldorf, 16114 N. 81st St., Scottsdale, AZ (US) 85260

( * ) Notice: Subject to any disclaimer, the term of this patent is extended or adjusted under 35 U.S.C. 154(b) by 0 days.

(21) Appl. No.: 09/683,446

(22) Filed: Dec. 31, 2001

(65) Prior Publication Data

US 2002/0043186 A1 Apr. 18, 2002

Related U.S. Application Data

(63) Continuation-in-part of application No. 09/634,282, filed on Aug. 9, 2000, now Pat. No. 6,334,399, and a continuation of application No. 09/372,932, filed on Aug. 12, 1999, now Pat. No. 6,161,489, which is a continuation-in-part of application No. 09/235,928, filed on Jan. 22, 1999, now Pat. No. 6,003,451.

(60) Provisional application No. 60/181,696, filed on Feb. 10, 2000.

(51) Int. Cl.[7] ..... A47B 13/08

(52) U.S. Cl. ..... 108/90; 24/459; 150/158

(58) Field of Search ..... 24/459; 108/93, 108/90, 161; 297/228.12; 248/188.1, 638, 188.8, 188.9; 135/98, 147, 157, 119, 96, 115, 77, 78, 79, 82–86; 150/158

(56) References Cited

U.S. PATENT DOCUMENTS

| | | | | |
|---|---|---|---|---|
| 120,530 A | * | 10/1871 | Penrose | 5/113 |
| 2,168,913 A | * | 8/1939 | Middleton | 135/157 |
| 4,175,305 A | * | 11/1979 | Gillis | 24/459 |
| 4,352,362 A | * | 10/1982 | Nichols | 135/98 |
| 4,631,887 A | * | 12/1986 | Francovitch | 52/410 |
| 6,003,451 A | * | 12/1999 | Kelldorf | 108/90 |
| 6,161,489 A | * | 12/2000 | Kelldorf | 108/90 |
| 6,334,399 B1 | * | 1/2002 | Kelldorf | 108/90 |

* cited by examiner

*Primary Examiner*—Jose V. Chen
(74) *Attorney, Agent, or Firm*—Novak Druce LLP

(57) ABSTRACT

Cupped arrangement for holding a fabric-type furniture cover in a use-configuration upon a furniture piece. The cupped arrangement includes an attachment portion defining a trap space. The trap space is configured to releasably engage a portion of a fabric-type furniture cover. An anchor portion is coupled to the attachment portion, the anchor portion having a cupped receiving space adapted to insertibly receive a foot portion of a leg of a furniture piece over which the fabric-type furniture cover is installable. The attachment portion and the anchor portion together establish a cupped receiver that is predominantly constructed from semi-rigid material, preferably plastic, that is form-retaining and that possesses sufficient flexure to accommodate releasable securement of the cupped receiver to a furniture cover. The cupped receiver is constructed of multi-parts that, based on relative positioning one to the others, establish an open configuration in which a portion of a furniture cover is insertible into the trap space and a closed configuration in which an inserted portion of a furniture cover is retained in the trap space. At least two of the multi-parts of the cupped receiver are configured to be conformance fitting one to the other, and also being capable of being snapped together, with the trap space established therebetween in the closed configuration.

7 Claims, 8 Drawing Sheets

SECUREMENT ARRANGEMENT

CROSS REFERENCE TO RELATED APPLICATIONS

This non-provisional patent application is a continuation-in-part of U.S. application Ser. No. 09/634,282, now U.S. Pat. No. 6,334,399 filed Aug. 9, 2000 which claims the benefit of Provisional Patent Application No. 60/181,696 filed Feb. 10, 2000, and which is a continuation of U.S. application Ser. No. 09/372,932, now U.S. Pat. No. 6,161,489 filed Aug. 12, 1999 which is a continuation-in-part of U.S. application Ser. No. 09/235,928, now U.S. Pat. No. 6,003,451 filed Jan. 22, 1999, several of which are entitled "TABLE COVER." Each of these patents and corresponding applications are hereby expressly incorporated by reference into the present application in their entireties for disclosure purposes.

BACKGROUND OF INVENTION

1. Field of the Invention

The present invention(s) relates generally to fabric-type covers for articles such as furniture pieces and semi-flexible panels such as may be used as room dividers or partitions; and more particularly, to accessories therefore. Specifically, the present invention(s) is directed toward anchors or stays for such article covers or panels.

2. Background of the Invention

Nondescript tables intended to be covered before use are well known in the entertainment, convention, and party industries. Typically, the underlying table is of a conventional design and without decorative features. The top of the table may be of any shape, but is typically either square, rectangular, round, or oval-shaped. A set of legs is attached to the underside of the table top. These legs are typically foldable into and out of a use configuration. The tables themselves are relatively unattractive and are almost always covered for use. In this manner, the cover may be selected such that the tables serve as a complement to the theme of an event.

Typically, conventional table covers have been simple drapes that are positioned over the table for uniform appearance. One problem with such designs is that no reference is provided to indicate when the draped table cover has been properly positioned. Therefore, the set up of such tables, especially when there is a large number, may be time-consuming. Each table must be visually inspected, typically from several different vantage points, to assure that each table looks right from all sides. Commonly, a conventional cloth table cover of inappropriate size will result in uneven overhangs. Further, such draped designs have long been in use and the entertainment, convention, and party industries desire new and novel appearances, as well as efficient designs for event accessories.

In home settings, the owner of furniture often times desires to change the appearance of the furniture simply and inexpensively. Examples include dining tables, coffee tables, end tables, and bedside tables. Tables of this nature may also be used in commercial settings, such as hotels, restaurants, and offices. Typically, the appearance of such furniture used in commercial settings is desired to be changed temporarily or permanently. As with private owners, commercial owners of furniture desire to make appearance changes simply, inexpensively, and interchangeably.

Typically, furniture covers have been draped over the furniture piece and held in position by their own weight, crude fastening devices such as screw-pins and even removable elastic straps are also familiar, but not very elegant commercial products. In the case of stretch furniture covers of the nature disclosed herein, the lower peripheries of the cover have commonly been secured by being tucked under the legs of the furniture piece being covered. This presents several problems, but the most obvious is that the weight of the furniture piece, plus any weight resting thereupon, is concentrated on the fabric cover at the points under the legs often causing holes and other unsightly wear-spots that limit the useful life of the cover unnecessarily early.

In view of the deficiencies described above associated with the use of conventional designs of furniture covers, the present invention(s) have been developed to alleviate these deficiencies and to provide further benefits to a user. These benefits are described in greater detail hereinbelow with respect to alternative embodiments of the present invention.

SUMMARY OF THE INVENTION

The present invention, in the disclosed embodiments thereof, alleviates the deficiencies described above with respect to conventionally designed drape table covers and incorporates several additionally beneficial features. Among the benefits provided to a user are the simplicity and durability of the table cover of the present invention. Another benefit is the clean, sculpted appearance the table cover provides when installed upon a table. A further benefit attractive to the entertainment, convention, and party industries is the versatility and ease in appearance-adaptation of the table cover of the present invention.

Both the table cover body and the overlay table top cover of the fabric table cover assembly of the present invention are constructed to be substantially form-fitting about a conventional party table. Because the fabric from which the body and cover are constructed is typically a stretch material, the body and cover are stretched about the table and secured thereupon. The stretch nature of the fabric causes the body and cover to constrict about the table and partially conform thereto. The result is a curvaceous appearance that is unique, somewhat space-age in effect, and pleasing to the eye.

A lower periphery of the bottom of the table cover is secured at the feet of the table. Because of the elastic nature of the lower periphery of the table cover, upward-extending arches are formed between the legs of the table. This is a developed feature highly desirable to users of the table because these arched areas provide gap spaces between the table cover and the floor that accommodate the insertion of a user's feet under the table. The lack of such access for the user's feet in conventional table cover designs has long affected the level of comfort and usability of such conventional designs.

In a preferred embodiment, the table cover of the present invention is constructed to have a top portion and a bottom portion configured to cover the top portion and the legged portion of a table, respectively. The top portion of the table cover is preferably made of a light-colored material, but at least a portion of the top portion of the table cover contains a light-colored area. The bottom portion of the table cover may be made of any colored material. Typically, however, the bottom portion of the table cover is black because of that color's versatility and ability to blend in many event settings.

The table cover body, described above, may be used alone. However, in another preferred embodiment, an overlay table top cover may be used that is stretched over the top portion of the table cover body. Typically, this overlay table top cover will have a predetermined pattern, such as stripes, polka-dots, or an animal print, that may be used to customize the appearance of the tables being covered and accent the event in which the tables are being used. Because the overlay table top cover is also constructed of stretch material to enable its simple installation over the top portion of the table cover body and cause conformity thereto, it is relatively simple for the color of the top portion of the table cover body to bleed through any light portions of the overlay table top cover. For this reason, the top portion of the table cover body is preferably constructed from a light-colored material, and more preferably, a white material. Through the use of such a light-colored material, bleed-through is prevented and the colors of the overlay table top cover are made more vibrant by the light-colored backdrop of the top portion of the table cover body. Further, the top portion of the table cover body of the present invention may be constructed from polyester-cotton blend materials that act as a pad under the overlay table top cover, eliminating the need for a separate pad.

The construction of the table cover body and the overlay table top cover enable quick, simple, and uniform installation of a plurality of table cover assemblies on a plurality of tables. This is important to event planners as set up time is typically at a premium. The set up time for an event is non-revenue generating and, therefore, desired to be minimized. The construction of the table cover assembly of the present invention enables a single person to install the cover quickly and accurately by himself or herself without damaging the table cover. This one-person installation is accommodated by the construction of the table cover and its method of installation and attachment upon a table. Because of the stretching nature of the table cover, the lower periphery of the bottom portion of the table cover may be hooked under the feet of the table's legs. This may be accomplished one leg at a time as the person moves about the table. Simultaneously, the top portion of the table cover, as well as the bottom portion of the table cover, may be stretched tautly about the table top and legged portions of the table, respectively. In this manner, as the person progresses about the table, each leg may be rocked off of the floor to permit placement of a securable portion of the cover thereunder. This type of installation prevents the table top from having to engage the floor and averts potential damage to the table cover if it were pinched between the table top and the floor.

In a preferred embodiment, the bottom portion of the table cover is constructed in a tube configuration using a longitudinal seam that may be used by an installer as a reference point for proper positioning of the table cover upon the table. By aligning the seam with a leg of the table, not only is a better appearance achieved for each table, but a uniform appearance across a plurality of tables is assured as each is similarly covered.

In at least one embodiment, the present invention takes the form of a fabric table cover assembly that includes a table cover body that has a top portion configured for covering a table top and a bottom portion configured for covering at least a portion of a supporting portion of a table. The bottom portion of the table cover body has a lower periphery configured to be anchored at securable locations, one of each of the securable locations to be anchored to one of the plurality of legs of the table to be covered. The lower periphery has extension portions between adjacent securable locations that are adapted to form upwardly-extending arches between adjacent securable locations. In this manner, accommodating access areas for feet are established between adjacent legs of the covered table.

The top portion of the table cover body is light-colored so that light-colored overlay table top cover fabrics positioned upon the top portion are unaffected in appearance color-wise by the top portion of the table cover body. In a preferred embodiment, the light-colored top portion of the table cover body is white for optimized color preservation of overlay table top cover fabrics. The bottom portion of the table cover body is preferably dark-colored for forming an opaque skin about the supporting portion of the covered table.

In one embodiment, the top portion and the bottom portion of the table cover body are separate fabric pieces joined together at a seam to form the table cover body. The seam may be configured to be located immediately below the top of the covered table when installed thereupon. Additionally, the overlay table top cover is configured to cover the top portion of the table cover body for presenting a contrasting appearance to the bottom portion of the table cover body. Preferably, the overlay table top cover is adapted to stretch tautly over the top portion of the table cover body in a form-fitting manner and for establishing a substantially uniform surface-to-surface engagement between the overlay table top cover and the top portion of the table cover body. Further, the overlay table top cover has at peripheral elastic band for constriction below the top of the covered table when installed thereupon. In a preferred embodiment, the overlay table top cover is constructed from stain and wrinkle-resistant material.

In another embodiment, the securable locations take, at least in part, the form of hookable portions at the bottom portion of the table cover body and are configured for being securingly hooked under the legs of the covered table. In an alternative embodiment, each securable location includes a cupped receiver positioned at the lower periphery of the bottom portion of the table cover body and is configured to securingly receive a foot portion of a leg of the covered table. The cupped receiver is adapted to be releasably engageable upon the lower periphery of the bottom portion of the table cover body. The durable cupped receiver is configured to be installed on the furniture cover and be positioned under a foot of the furniture piece thereby avoiding undue wear and damage to the cover as opposed to if it had been tucked under the foot as described hereinabove regarding traditional securement means and methods.

In one embodiment, each cupped receiver includes a first body piece and a second body piece that are substantially conforming or form-fitting to one another. The first body piece may be snapped into the second body piece such that the lower periphery of the table cover is caught between the first body piece and the second body piece. The first body piece may have raised ridges or fins operable for securing the lower periphery of the table cover within the cupped receiver. The first body piece of the cupped receiver has an interior foot receiving area for receiving the foot of a leg of the table therein. The cupped receiver is releasably engageable and may be made of any substantially rigid, durable material, such as plastic or rubber. The cupped receiver is preferably constructed from a material of a color that complements or contrasts the table cover.

In another embodiment, each cupped receiver includes a first body piece, a second body piece, and a securing piece that are substantially conforming. The first body piece of the cupped receiver has an interior foot receiving area for receiving the foot of a leg of the table therein. The first body piece is securely disposed within the second body piece of the cupped receiver, the second body piece including a securing piece receiver. The securing piece of the cupped receiver has a table cover receiving hook for receiving the lower periphery of the table cover. The securing piece snappingly engages the securing piece receiver of the second body piece, catching the lower periphery of the table cover between the securing piece and the second body piece. The cupped receiver is releasably engageable and may be made of any substantially rigid, durable material, such as plastic or rubber.

In one aspect, the invention takes the form of a cupped arrangement for holding a fabric-type furniture cover in a use-configuration upon a furniture piece. The cupped arrangement includes an attachment portion defining a trap space. The trap space is configured to releasably engage a portion of a fabric-type furniture cover. An anchor portion is coupled to the attachment portion, the anchor portion having a cupped receiving space adapted to insertibly receive a foot portion of a leg of a furniture piece over which the fabric-type furniture cover is installable. The attachment portion and the anchor portion together establish a cupped receiver that is predominantly constructed from semi-rigid material, preferably plastic, that is form-retaining and that possesses sufficient flexure to accommodate releasable securement of the cupped receiver to a furniture cover. The cupped receiver is constructed of multiparts that, based on relative positioning one to the others, establish an open configuration in which a portion of a furniture cover is insertible into the trap space and a closed configuration in which an inserted portion of a furniture cover is retained in the trap space. In one example, at least two of the multi-parts of the cupped receiver are configured to be conformance fitting one to the other, and also being capable of being snapped together, with the trap space established there between in the closed configuration. It should be appreciated that these types of anchors or cupped receivers may also be utilized on fabric-type panels that are not necessarily employed as furniture covers, but which may take the form of sheeting such as that used to temporarily partition a room.

Preferably, the bottom portion of the table cover body is constructed from a stretch fabric and is configured to fit tautly about the supporting portion of the covered table thereby presenting a curvaceous appearance about the supporting portion when installed. Optionally, the stretch fabric from which the bottom portion of the table cover body is constructed is a spandex material. Further, the bottom portion of the table cover body includes a peripheral elastic band for constriction about the lower portion of the supporting portion of the covered table, thereby forming the upwardly-extending arches and presenting a fluted appearance at the base of the covered table.

The beneficial effects described above apply generally to all exemplary devices, mechanisms, and methods disclosed herein. Specific structures and methods through which these benefits may be delivered are described in detail hereinbelow.

BRIEF DESCRIPTION OF DRAWINGS

The present invention(s) will now be described in greater detail with reference to the attached drawings, in which.

DETAILED DESCRIPTION

Figure 1:
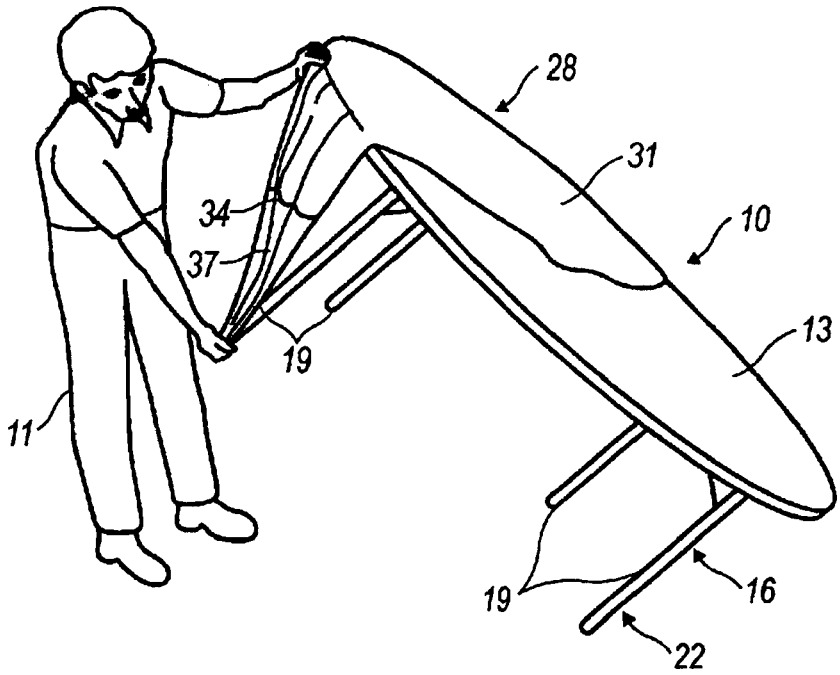
FIG. 1 is a perspective view illustrating an initial installation step of a table cover body of the table cover assembly configured and used according of the teachings of the present invention(s) onto a furniture piece.

As required, preferred embodiments of the present invention(s) and their several aspects are disclosed herein, however, it is to be understood that the preferred embodiments are merely exemplary, an should not be construed as limiting the scope of the included claims. The present invention(s) may be embodied in various and alternative forms. The figures are not necessarily to scale, and some features may be exaggerated or minimized to highlight the details of particular components. Therefore, specific structural and functional details disclosed herein are not to be interpreted as limiting, but merely as a basis for the claims and as an aide for teaching one of ordinary skill in the art to variously employ the present invention.

Referring to FIGS. 1–6, a table cover assembly 25 may be appreciated that is usable for covering a table 10 having a top 13 and a supporting portion 16. The supporting portion 16 of the table 10 includes a plurality of legs 19, each of which has a foot portion 22.

Referring to FIG. 1, in one embodiment, a table cover body 28 is configured for installation over the table 10. The table cover body 28 includes a top portion 31 and a bottom portion 37, preferably joined together by a seam 34. The bottom portion 37 is constructed from a stretching material, such as spandex. The top portion 31 is constructed from a substantially stretch-resistant polyester-cotton blend material that is also stain and wrinkle-resistant. Because the top portion 31 is substantially stretch-resistant, the top portion 31 may be sized to fit a predetermined table configuration, most of such table configurations being of standard shapes and sizes in the event planning industries. Also, because the top portion 31 is substantially stretch-resistant, the top portion 31 of the table cover body 28 assists in properly locating and shaping the bottom portion 37 of the table cover body 28 once properly positioned on the table top 13. This is possible because the top portion 31 of the table cover body 28 provides a continuous anchor about its perimeter for the top edge of the lower portion 37 of the table cover body 28.

Figure 3:
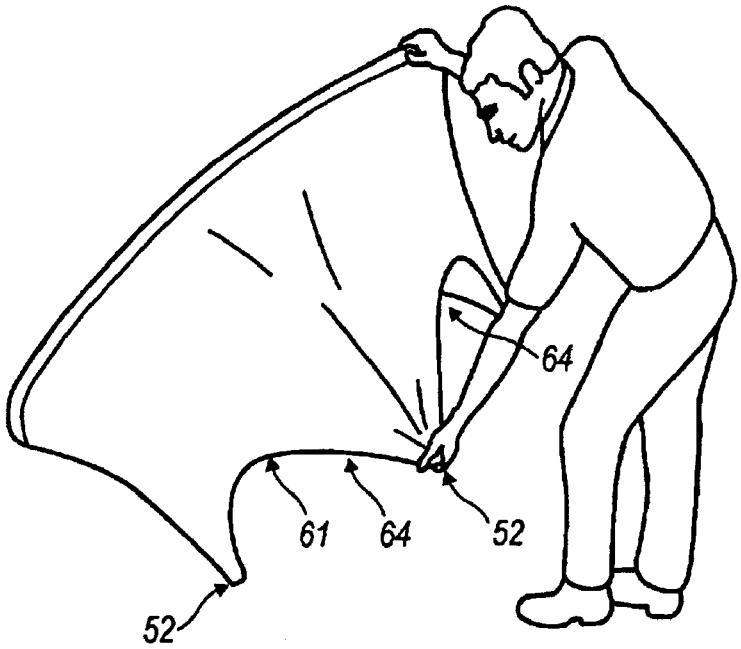
Figure 4:
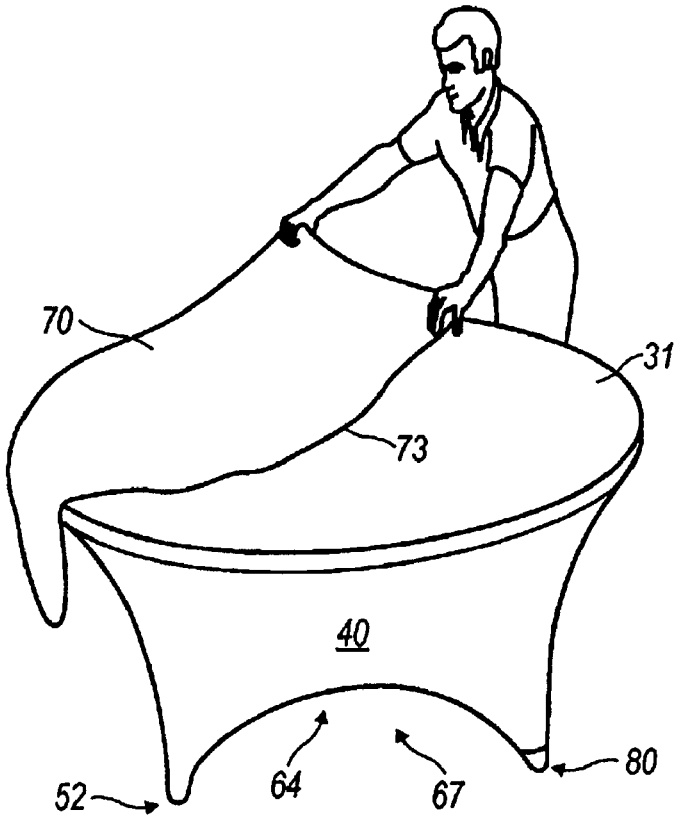
FIG. 4 is a perspective view illustrating an initial installation step of an overlay table top cover of the table cover assembly and a cupped receiver schematically illustrated at the foot of the furniture piece.

Because of the stretch nature of the material of the bottom portion 37, the table cover body 28 exhibits an elastic effect through its constrictive characteristics about the table 10. Referring to FIGS. 3 and 4, these characteristics enable the table cover body 28 (FIG. 1) to be at least partially form-fitting about the table 10 (FIG. 1) in a curvaceous manner that produces the unique appearance of the installed table cover assembly 25 (FIG. 1).

Figure 2:
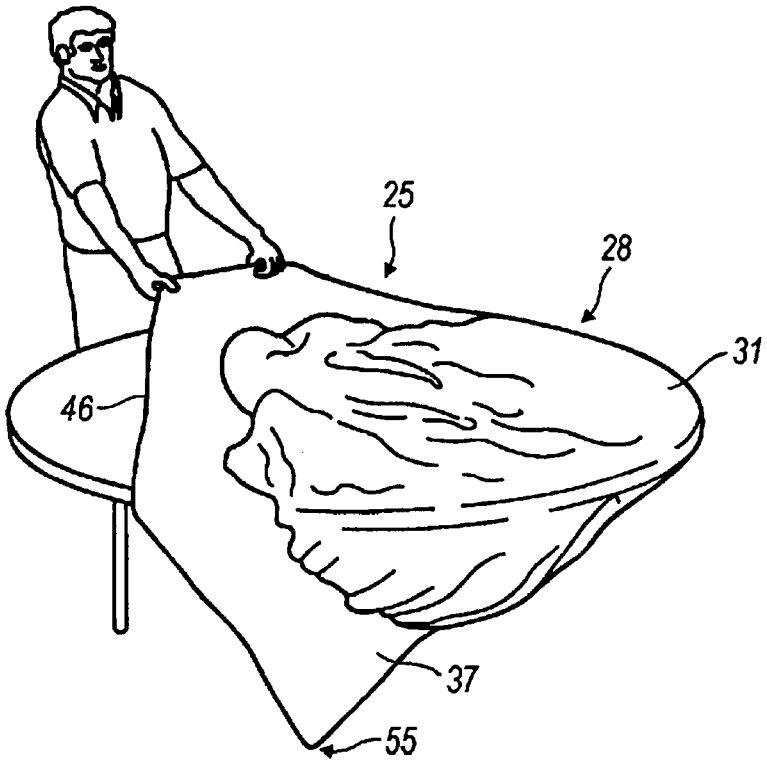
FIGS. 2 and 3 are perspective views illustrating subsequent installation steps of the table cover body.

Referring to FIGS. 1–3, the installation process begins with an installer 11 positioning the table cover body 28 substantially upon the table top 13. At least one leg 19 of the table 10 is lifted off of the ground such that the bottom portion 37 of the table cover body 28 may be anchored at a securable location 52 at the foot portion 22 of the leg 19. In a preferred embodiment, the securable locations 52 are at a lower periphery 49 (FIG. 5) of the bottom portion 37 of the table cover body 28. Optionally, a peripheral elastic band 46 may be included at the lower periphery 49. It is also possible for the material from which the bottom portion 37 is constructed to perform satisfactorily using its own elastic qualities. In the embodiment illustrated in FIGS. 1 and 2, the securable location 52 takes the form of a hookable portion 55, achieved by pulling the lower periphery 49 underneath the foot portion 22 of the leg 19 and permitting it to constrict thereunder.

In another aspect, and as schematically illustrated in the lower right-hand portion of FIG. 4, a cupped receiver 80 is employed at the lower periphery 49 for installation of the table cover body 28 under the foot 22 of the leg 19. This cupped receiver 80 may take a variety of forms as herein described.

Figure 7:
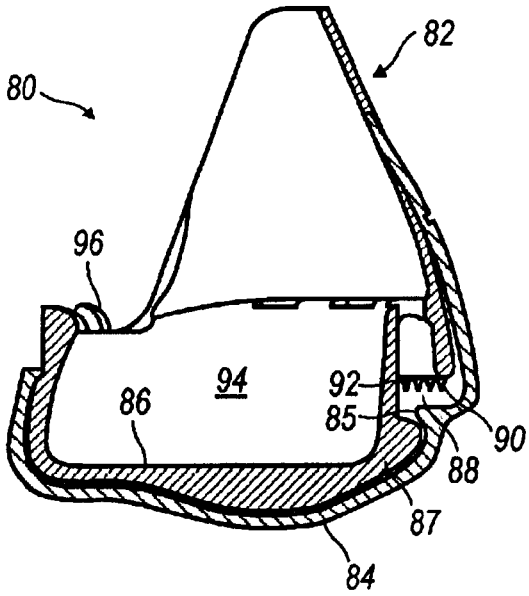
FIG. 7 is a cross-sectional view of one embodiment of a two-piece cupped receiver configured according to one aspect of the presently disclosed invention(s)
Figure 8:
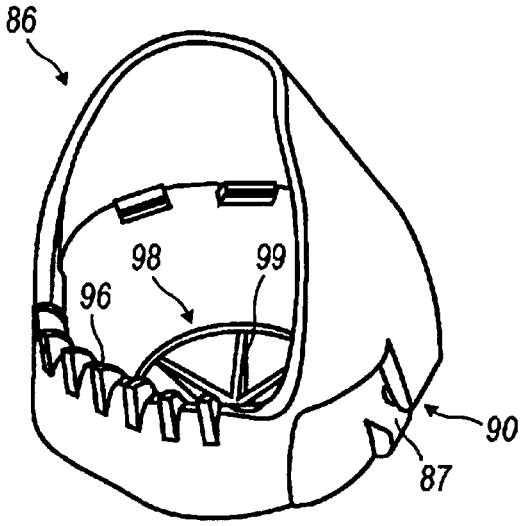
FIG. 8 is a perspective view of an interior insert of the two-piece cupped receiver illustrated in FIG. 7.
Figure 9:
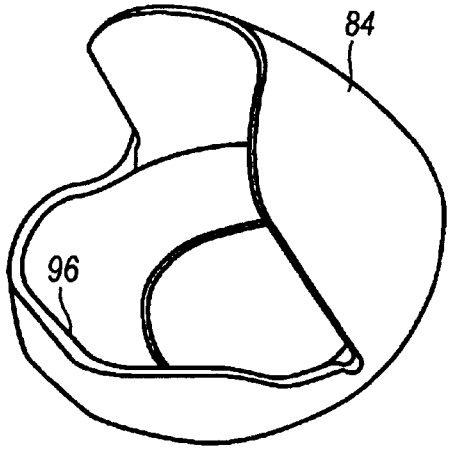
FIG. 9 is a perspective view of an outer shell of the two-piece cupped receiver illustrated in FIG. 7.

Referring to FIGS. 7–9, in one embodiment, each cupped receiver 80 includes a first body piece 86, or an interior insert, and a second body piece 84, or an outer shell, that are substantially conforming to one another. The first body piece 86 may be snapped into the second body piece 84 such that the lower periphery 49 of the table cover body 28 is caught between the first body piece 86 and the second body piece 84. These pieces 84 and 86 maybe completely separate from one another, or may be coupled together in a way that facilitates relative movement between the pieces.

The first body piece 86 may have raised ridges or fins 96 operable for securing the lower periphery 49 of the table cover body 28 within the cupped receiver 80 and to the foot portion 22 of a leg 19 of the table 10. The first body piece 86 of the cupped receiver 80 has an interior foot receiving area 94 for receiving the foot portion 22 of the leg 19 of the table 10 therein. The cupped receiver 80 is releasably engageable and may be made of any substantially rigid, durable material, such as plastic or rubber. The cupped receiver 80 is preferably constructed from a material of a color that appealingly blends with, or contrasts with the furniture cover.

Figure 10:
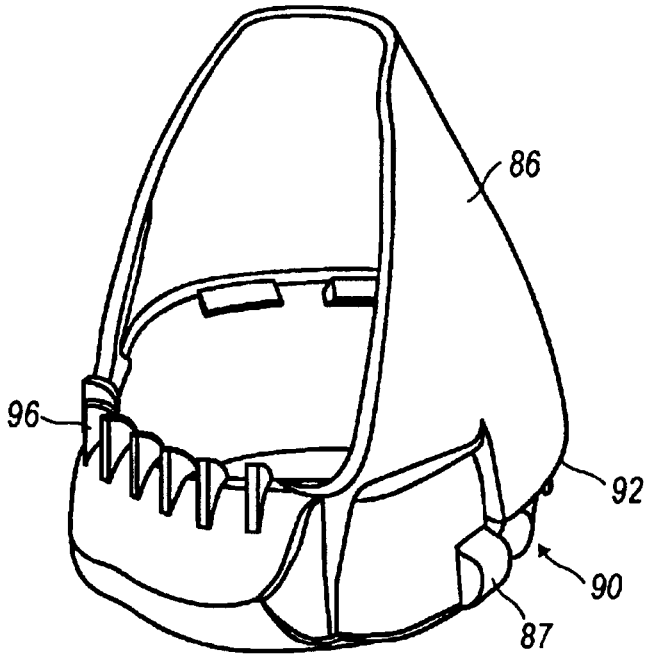
FIG. 10 is a perspective view of an alternative embodiment of an interior insert of a two-piece cupped receiver arrangement according to the present invention.
Figure 11:
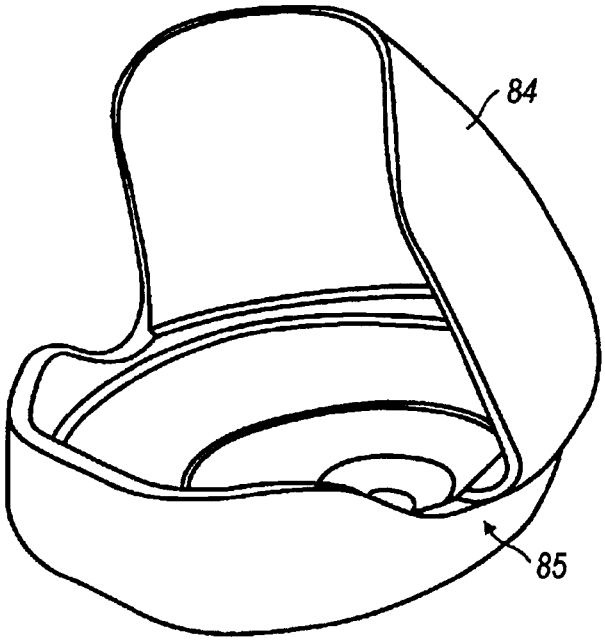
FIG. 11 is a perspective view of an outer shell of the two-piece cupped receiver illustrated in FIG. 10.

Referring to FIG. 7, an assembled cupped receiver 82 is established from two separate pieces, an outer shell 84 and an interior insert 86. FIG. 9 illustrates an exemplary outer shell 84 configured to be engaged upon an interior insert 86, such as that illustrated in FIG. 8. FIGS. 10 and 11 illustrate alternative interior insert 86 and outer shell 84 configurations, respectively. The character of this alternative embodiment is, however, sufficiently similar to that of FIGS. 7–9 to allow like reference numerals to be employed across the FIGS. 7–11.

As illustrated, the cupped receiver 80 is formed by the snapping engagement of the outer shell 84 about the interior insert 86. The outer shell 84 includes a catch projection 85 that projects over and snaps about a protrusion 87 of the interior insert 86. In this manner, the outer shell 84 and the interior insert 86 are made releasably engageable. The interior surface of the outer shell 84 is configured to substantially conform to the exterior surface of the interior insert 86, providing substantial face-to-face abutment. When assembled, a cover securement recess 88 is established between the outer shell 84 and the interior insert 86. The cover securement recess 88 is used for securingly receiving a portion of the lower periphery 49 of the bottom portion 37 of the table cover body 28. Securement of the cupped receiver 80 to the table cover body 28, or to any other similarly constructed cover, is established by snapping the outer shell 84 and the interior insert 86 together with the portion of the cover intended to be secured positioned therebetween. With respect to a cover in which an elastic band 46 has been incorporated, the enlarged cord caused by the presence of the elastic band 46 provides an expanded portion simply trapped in the cover securement recess 88 between the outer shell 84 and the interior insert 86.

Friction members 90 are provided in the form of spiked teeth 92 that stab into the secured portion of the table cover body 28. Through the use of the spiked teeth 92, disengagement of the table cover body 28 from the cupped receiver 80 is resisted until the outer shell 84 and the interior insert 86 are purposefully disengaged and the cover securement recess 88 is opened.

The interior foot receiving area 94 is established within the interior space of the cupped receiver 80. This interior foot receiving area 94 is operable for receiving the foot portion 22 of a leg 19 of the table 10 therein. The fit of the interior foot receiving area 94 about the foot portion 22 may be sufficiently snug to maintain an engagement therebetween. Further, the elastic nature of the material of the table cover body 28 will typically place an upward force on the cupped receiver 80 that tends to hold the cupped receiver 80 tightly upon the foot portion 22 of the leg 19 of the table 10. To assist the installer in properly positioning the foot portion 22 in the interior foot receiving area 94, a sloped access lip 96 is provided that directs the foot portion 22 to slide into the interior foot receiving area 94 for proper positioning therein. Because there is a possibility that a relatively great amount of downward force may be exerted upon the cupped receiver 80, especially if the cupped receiver 80 is used on a chair cover, a bottom portion 98 of the cupped receiver 80 is reinforced using reinforcing ribs 99. The reinforcing ribs 99 may extend radially from the center of the interior insert 86, toward the circumference thereof. The reinforcing ribs 99 may take the form of vanes that are perpendicularly oriented to the bottom interior surface of the interior insert 86.

Figure 12:
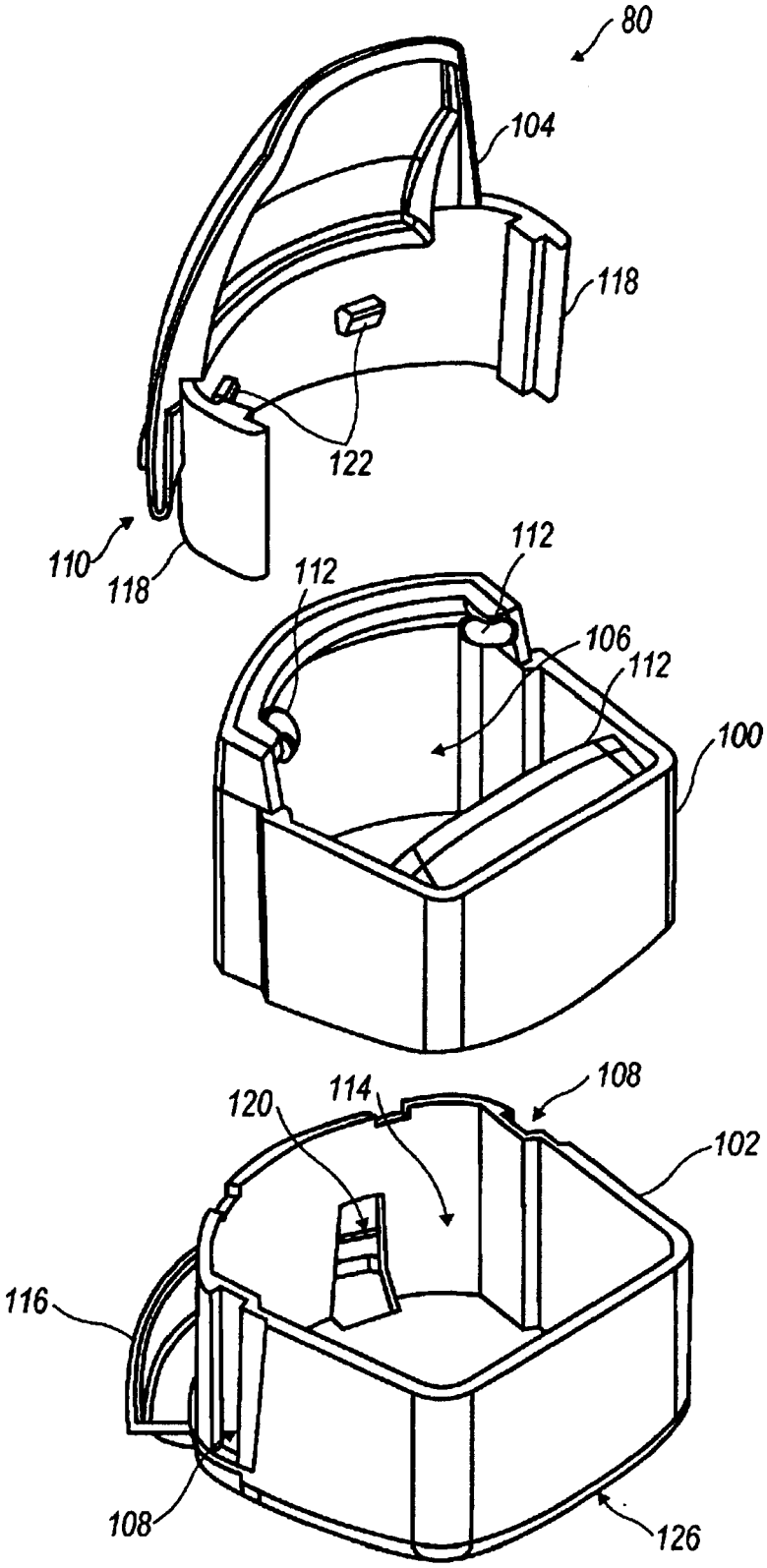
FIGS. 12 and 13 are exploded perspective views of one embodiment of a three-piece cupped receiver configured according to the teachings of the present invention (s)
Figure 13:
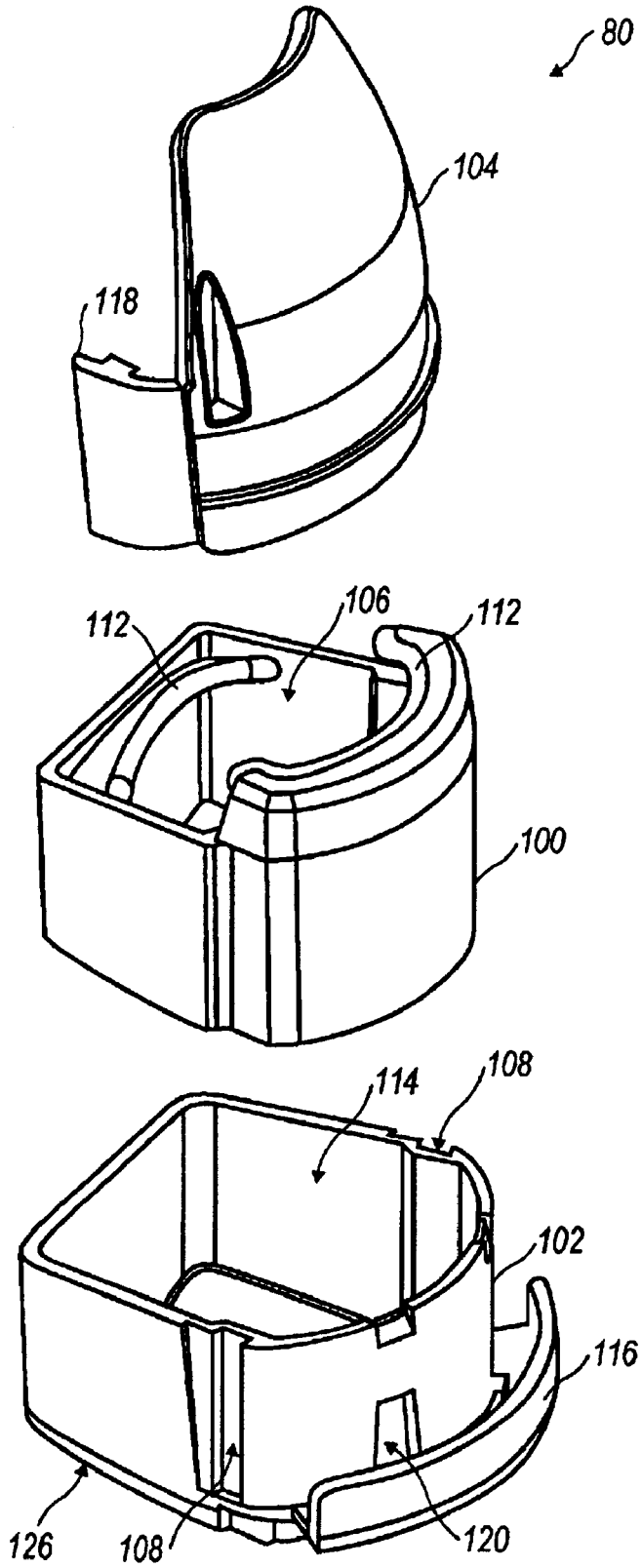

Referring to FIGS. 12 and 13, in another embodiment, each cupped receiver 80 includes a first body piece 100, a second body piece 102, and a securing piece 104 that are substantially conforming with one another. The first body piece 100 of the cupped receiver 80, or the foot receiving piece 100, has an interior foot receiving area 106 for receiving the foot portion 22 of a leg 19 of the furniture piece 10 therein. The foot receiving piece 100 is securely disposed within the second body piece 102 of the cupped receiver 80, or the base piece. The second body piece 102 includes a securing piece receiver 108. The securing piece 104 of the cupped receiver 80 has a table cover receiving hook 110 for receiving the lower periphery 49 of the table cover body 28. The securing piece 104 snappingly engages the securing piece receiver 108 of the second body piece 102, catching the lower periphery 49 of the table cover body 28 between the securing piece 104 and the second body piece 102. The cupped receiver 80 is releasably engageable and may be made of any substantially rigid, durable material, such as plastic or rubber.

The first body piece 100 of the cupped receiver 80 may be substantially round, substantially square, any other suitable shape, or it may have substantially round portions and substantially square portions. The interior foot receiving area 106 of the first body piece 100 preferably includes projecting or raised fin structures 112 operable for engaging the foot portion 22 of the leg 19 of the table 10. Optionally, these raised fin structures 112 may each include a rubber bead operable for securing the first body piece 100 to the foot portion 22 of the leg 19 of the table 10. As illustrated, the fin structures 112 are more horizontally oriented, but the fin(s) 112 may also be substantially vertically oriented. In such a vertical orientation, the raised fin structures 112 may also be angled such that the foot portion 22 of the leg 19 of the table 10 is guided as it is slid into the interior foot receiving area 106 of the first body piece 100. The angled nature of these fin(s) 112 may be configured to form a downwardly tapered space 106 so that variously sized and configured furniture feet 19 can be frictionally engaged. If the interior space is tapered, variously sized feet 19 will be accommodated, but smaller feet will project further into the receiving space 106 than a larger feet 19 which will abut the tapered fins 112 earlier during insertion and therefore not rest as deeply in the receiving assembly 80.

The second body piece 102 of the cupped receiver 80 includes an interior receiving space 114 for receiving the first body piece 100 and a bottom piece 126. Preferably, the interior receiving space 114 of the second body piece 102 substantially conforms to the first body piece 100. The second body piece 102 also includes the securing piece receiver 108 and a table cover body receiver 116. The securing piece receiver 108 includes a plurality of recessed channels operable for snappingly engaging a plurality of protruding portions 118 of the securing piece 104. The table cover body receiver 116 is a shelf structure operable for catching and securing the lower periphery 49 of the table cover body 28 between the second body piece 102 and the securing piece 104. The second body piece 102 further includes a plurality of securing channels 120 operable for receiving a plurality of securing teeth 122 of the securing piece 104. Together, the plurality of securing channels 120 and the plurality of securing teeth 122 prevent the securing piece 104 from being pulled upward by the table cover body 28.

Figure 14:
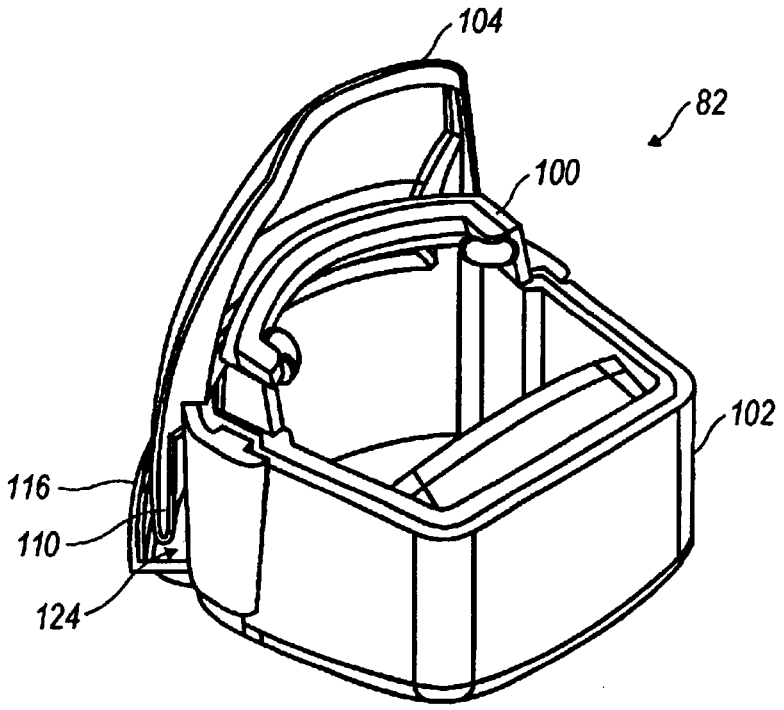
FIGS. 14 and 15 are perspective views of the assembled three-piece cupped receiver illustrated in FIGS. 12 and 13.
Figure 15:
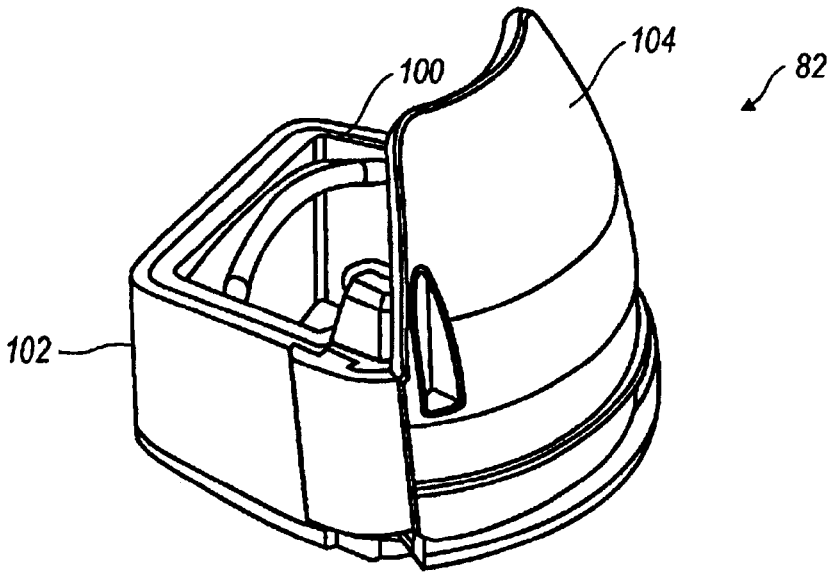

As described above, the securing piece 104 includes a table cover receiving hook 110 for receiving the lower periphery 49 of the table cover body 28. Referring to FIG. 14, when the securing piece 104 and the second body piece 102 are engaged, the table cover receiving hook 110 and the table cover body receiver 116 form a table cover channel 124 in which the lower periphery 49 of the table cover body 28 is disposed. FIG. 15 provides further illustration of the unified cupped receiver 82.

In operation, the foot portion 22 of a leg 19 of the table 10 is disposed within the first body piece 100. Advantageously, the first body piece 100 may be left on the foot portion 22 of the leg 19 of the table 10 temporarily or permanently. The first body piece 100 is then disposed within the second body piece 102. The lower periphery 49 of the table cover body 28 is hooked or caught using the table cover receiving hook 110 of the securing piece 104. The securing piece 104 is then snappingly engaged with the second body piece 102, securing the lower periphery 49 of the Table cover body 28 between the securing piece 104 and the second body piece 102. Alternatively, the securing piece 104 may be engaged with the second body piece 102 prior to disposing the first body piece 100 within the second body piece 102. The securing piece 104 and the second body piece 102 may then be fitted under the first body piece 100, securing the table cover body 28 about the table 10.

Because of the design of the cupped receiver 80, it should be appreciated that the cupped receiver 80 may be used in conjunction with a plurality of covers and structures, such as covers for chairs, covers for other types of furniture, and covers for other articles that have fabric, fabric-type and otherwise similarly constructed portions that are desired to be secured or anchored. The fabric-type material may be as simple as plastic sheeting. For example, covers for paintings may be desired to be secured or anchored at corners over which such cupped receivers 80 can be aptly hung. It should be appreciated that the cupped receiver 80 need not be round in configuration, but may be configured to accommodate variously shaped elements. In the case of a cover to be secured about a painting at the corners of a frame thereof, the cupped receiver 80 may be substantially square in shape for catching upon the corners of the frame. Such anchors may also be used with panels constructed from stretch fabrics that are connected between the anchors for forming a partition-type room divider. Further, the cupped receiver 80 may be used to establish projection screens of various characteristics.

It should be appreciated that an additional benefit is derived from using cupped receivers 80 at the ground engaging portions of the feet of a table and, more pertinently, at the ground engaging portions of the feet of a chair. The inner and outer components of the cupped receiver 80 are preferably constructed from a hard plastic, such as polyvinyl chloride (PVC). Further, the bottom exterior surface of the cupped receiver 80 is generally convex shaped or, at a minimum, has upwardly curved edges such that the sliding action of the table or chair over a supporting floor is facilitated. This may be attributed to the cupped receivers 80 acting as sleds over carpeted surfaces and reduced surface-to-surface contact on hard surfaces. Further, because the cupped receivers 80 are made from a semi-rigid material, the cupped receivers 80 also act as a buffer and protects the flooring from such sliding action which may otherwise mar or gouge the surface of the flooring.

It is also contemplated that a one-piece cupped receiver may be constructed according to the criteria established for the cupped receiver 80 illustrated in FIGS. 7–15. An arrangement is provided upon the body of the cupped receiver for affecting an attachment between the cupped receiver and the cover to be secured or anchored. Ideally, this attachment is releasable in nature, however, the attachment may also be permanent.

Returning to the furniture cover aspect of the invention(s), reference to FIG. 2, illustrates continued installation of a table cover as the installer 11 moves from one leg 19 to the next leg 19 anchoring the bottom portion 37 of the table cover body 28 under the foot portion 22 of each leg 19 at a securable location 52 until finally the configuration illustrated in FIG. 3 is achieved. There, it can be appreciated that extension portions 61 span between the securable locations 52 and, when the table cover body 28 is installed upon the table 10, form upwardly extending arches 64 between each pair of legs 19. Referring to FIG. 4, each arch 64 provides a feet accommodating access area 67 for those persons who sit at the covered table 10. This feature improves the comfort level of those persons attending an event, increasing the usability of the tables 10.

In the illustrated embodiment, the top portion 31 of the table cover body 28 is round shaped and the bottom portion 37 is tubular. The tube of the bottom portion 37 is formed by sewing a sheet of material at end portions thereof utilizing a tube-forming seam 43. The seam 43 may be used by an installer 11 to assure proper positioning of the table cover body 28 upon the table 10. When beginning installation, as illustrated in FIG. 1, the seam 43 may be aligned with the leg 19 under which the bottom portion 37 is first anchored. If this system is consistently utilized, a uniform appearance across a plurality of tables 10 in an event setting may be achieved.

Figure 5:
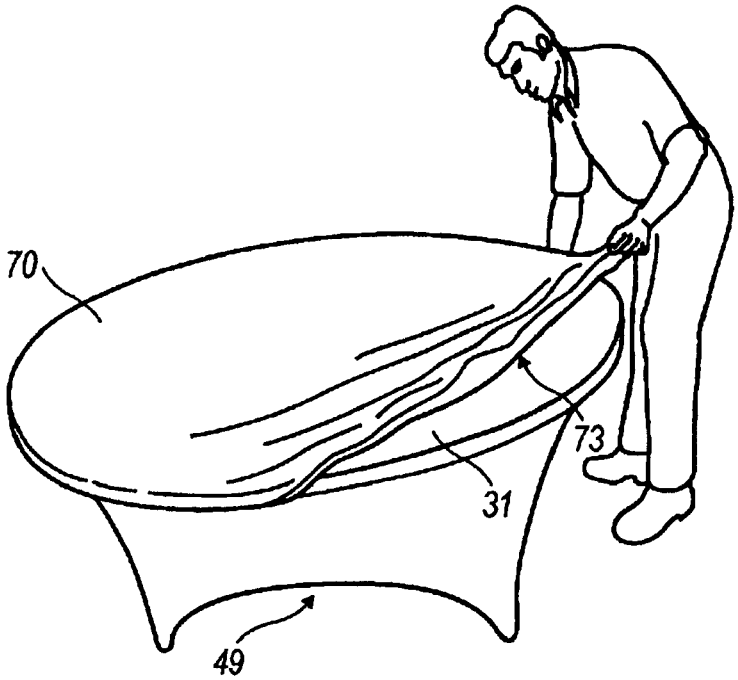
FIG. 5 is a perspective view illustrating a subsequent installation step of the overlay table top cover.
Figure 6:
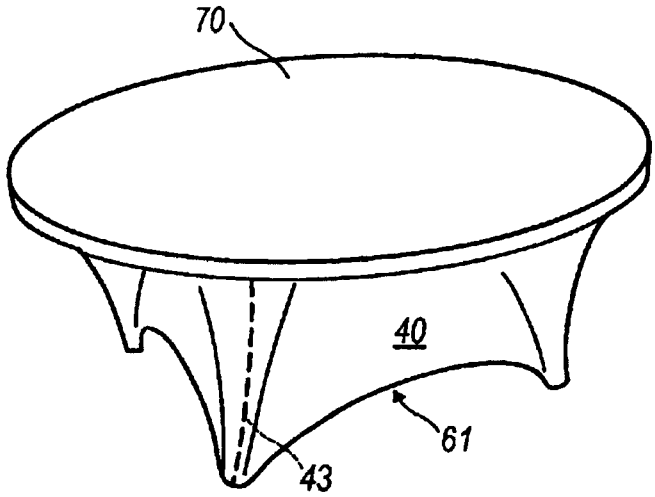
FIG. 6 is a perspective view illustrating an installed table cover body and overlay table top cover.

An optional component of the table cover assembly 25 is an overlay table top cover 70. The use of such an overlay table top cover 70 is illustrated in FIGS. 4–6. Typically, the overlay table top cover 70 has a specific design that has been selected to complement the theme of an event. Examples of such designs include colored polka-dots, flag patterns, and animal prints. In each case, the overlay table top cover 70 is preferably constructed of a stretch material that is secured about the top 13 of the table 10, over the top portion 31 of the table cover body 28, using a peripheral elastic band 73. The more the overlay table top cover 70 is stretched, the more transparent the material becomes. This is especially true with respect to light-colored portions in the design of the overlay table top cover 70. For this reason, the top portion 31 of the table cover body 28 is preferably constructed of a light-colored material, and more preferably from a white material. Thus, lighter colors of the overlay table top cover 70 are not washed out by the dark underlay, but are instead preserved and enhanced by the light color of the top portion 31 of the table cover body 28.

The overlay table top cover 70 is an important component as it incorporates adaptability into the table cover assembly 25. By using standard table cover bodies 28 with custom overlay table top covers 70, dramatically different appearances may be achieved using the same table cover body 28 and table 10. This feature is attractive to event planners who must be able to provide a wide range of appearances on a finite budget. In an exemplary embodiment, the bottom portion 37 of the table cover body 28 is constructed from a dark-colored material, such as black spandex, that forms an opaque skin 40 about the supporting portion 16 of the table 10 when properly installed. In this configuration, the table cover assembly 25 presents a solid, sculpted appearance over the previously unattractive skeletal table 10, such as that available at most convention and party events.

A table cover assembly and its components have been described herein. These and other embodiments which will be appreciated by those of ordinary skill in the art are within the intended scope of the present invention as claimed below. As stated previously, detailed embodiments of the present invention have been described herein. It is to be understood, however, that the disclosed embodiments are merely exemplary of the present invention, which may be embodied in various forms.

What is claimed is:

1. A cupped furniture cover anchor for holding a fabric furniture cover in a use-configuration upon a furniture piece, said anchor comprising:

an attachment portion defining a trap space, said trap space configured to releasably couple to an edge portion of a fabric furniture cover;

an anchor portion coupled to said attachment portion, said anchor portion having a cupped receiving space adapted to insertibly receive a foot portion of a leg of a covered furniture piece; and said cupped receiving space being at least partially defined by a substantially continuous bottom wall that constitutes a buffer between the foot portion of the leg of the covered furniture piece and the supporting surface upon which the covered furniture piece rests.

2. The anchor as recited in claim 1, wherein said attachment portion and said anchor portion together establish a cupped receiver, said cupped receiver being predominantly constructed from semi-rigid material that is form-retaining and that possesses sufficient flexure to accommodate releasable securement to a furniture cover.

3. The anchor as recited in claim 2, herein said cupped receiver is constructed from plastic.

4. The anchor as recited in claim 1, wherein said attachment portion and said anchor portion together establish a cupped receiver, said cupped receiver configured to establish an open configuration in which the edge portion of the fabric furniture cover is insertible into said trap space and a closed configuration in which the inserted portion of the fabric furniture cover is retained in said trap space.

5. The anchor as recited in claim 4, wherein two constituent components of said anchor are conformance fitting in said closed configuration.

6. The anchor as recited in claim 5, wherein said two constituent components of said anchor are configured for snap-together interconnection.

7. The anchor as recited in claim 1, wherein said anchor portion further comprises catch-teeth for frictional engagement with edge portion of the fabric furniture cover.

* * * * *